United States Patent [19]

Riedl

[11] Patent Number: 4,706,936

[45] Date of Patent: Nov. 17, 1987

[54] MANUAL CRANK ASSEMBLY FOR WINCHES, ESPECIALLY FOR RACK AND PINION JACKS OF A LIFTING AND DEPOSITING DEVICE FOR PORTABLE BOX-LIKE ARTICLES, E.G. LARGE CONTAINERS

[75] Inventor: Reinhold Riedl, Miltenberg, Fed. Rep. of Germany

[73] Assignee: Haacon Hebetechnik GmbH, Freudenberg/Main, Fed. Rep. of Germany

[21] Appl. No.: 830,749

[22] Filed: Feb. 19, 1986

[30] Foreign Application Priority Data

Feb. 23, 1985 [DE] Fed. Rep. of Germany ..... 3506422

[51] Int. Cl.[4] ..... B66F 7/12

[52] U.S. Cl. ..... 254/89 R

[58] Field of Search ..... 254/95, 97, 98, 103, 254/89 R, 424–427; 192/56 R

[56] References Cited

U.S. PATENT DOCUMENTS

| | | | |
|---|---|---|---|
| 2,161,136 | 6/1939 | Conradson | 254/425 |
| 2,499,005 | 2/1950 | Sellers | 254/97 X |
| 4,137,784 | 2/1979 | Griffin | 254/103 X |
| 4,417,650 | 11/1983 | Geisthoff | 192/56 R |

*Primary Examiner*—Robert C. Watson

*Attorney, Agent, or Firm*—Quaintance, Murphy & Presta

[57] ABSTRACT

With a lifting and depositing device for portable box-like articles, in order to be able to operate their rack and pinion jacks manually and with ease by crank assemblies, each crank assembly has a haft-like crankcase, which has at one end a rotatable crankshaft and at the other end a rotatable drive shaft, which can be connected with an adjacent rack and pinion jack having a winch housing. The crankshaft and drive shaft are operatively connected with each other so that the latter is driven by the former. The crankcase can be connected with an adjacent winch housing and be pivoted into different work positions as well as fixed in such positions on the winch housing. Thus, the operation of the rack and pinion jacks is especially simplified in their top and bottom end positions on the uprights of the lifting and depositing device.

15 Claims, 11 Drawing Figures

MANUAL CRANK ASSEMBLY FOR WINCHES, ESPECIALLY FOR RACK AND PINION JACKS OF A LIFTING AND DEPOSITING DEVICE FOR PORTABLE BOX-LIKE ARTICLES, E.G. LARGE CONTAINERS

BACKGROUND OF THE INVENTION

The present invention relates to a manual crank assembly for winches, especially rack and pinion jacks of a lifting and depositing device for portable box-like articles, e.g. large containers, wherein the rack and pinion jacks may be connected to the corners of a large container, its spur racks provided on uprights for the large container, so that the rack and pinion jacks can be raised and lowered along each upright by operation of corresponding manual cranks. "Portable box-like articles" is to understood in the broadest meaning of the term, to include any articles, including platforms and pallets, which allow fastening of the winch to its corners or outside edges. "Large container" as used herein is therefore only a generic term.

A lifting and depositing device for the above purposes, of which the rack and pinion jacks can be operated by manual cranks, is already known from German Utility Pat. No. 82 35 609. Using this lifting and depositing device, large containers can be raised from the loading surface of a truck and placed on the ground or, vice versa, raised from the ground and deposited on the loading surface. Since height differences of generally 1.70–1.80 m. are to be covered with this lifting and depositing process, operation of the manual crank is difficult in the vicinity of both end positions of the rack and pinion jacks. In the bottom end position, complete turning of the manual crank is often no longer possible, since the handle contacts the ground. In order to provide some relief here, the manual crank has been provided with a ratchet mechanism, which allows only a portion of a complete crank turn. This too means a waste of time in the handling of the relevant large container. On the other hand, in the top end position of the rack and pinion jack, the rotation of the manual crank then becomes cumbersome.

SUMMARY OF THE INVENTION

The object of the present invention is to simplify the operation of the manual crank for rack and pinion jacks of a lifting and depositing device of this type, especially in the area of both end positions of the rack and pinion jacks on their uprights. At the same time, the lifting and depositing processes can be carried out more rapidly in comparison with the state of the art.

According to the present invention, this is attained in that:

(a) the manual crank has a haft-like crankcase, which on one end has the crankshaft and on the other end has at least one drive shaft which can be connected with the relevant rack and pinion jack; and (b) the crankshaft is connected with the drive shaft by power trains in the crankcase and can thus be driven.

According to the invention, as a result of the separation of the crankshaft from the drive shaft which is usually supporting a square drive journal or inside square, and on the basis of the spaced arrangement of these shafts in a haft-like crankcase, the advantage is attained that the manual cranks can be brought to any height setting of the rack and pinion jacks on the uprights in an operationally correct position, i.e. operationally correct so that it is favorable to the operator. In the vicinity of the top and bottom end positions of the rack and pinion jacks on the uprights, the crankcase is held correspondingly bent downward and upward on the winch housing. Since, therefore, even in the bottom setting of the rack and pinion jack, even a complete turn of the hand crank is possible, and the time required for lifting and depositing a large container from or onto the ground is cut down. The ergonomically optimal position of the operator also provides an altogether higher mean speed with less rapid occurence of fatigue, whereupon further time savings occur. In an emergency, it is advantageous that the haftlike crankcase also allows an extension of the lifting height in comparison with the state of the art. The haftlike crankcase can be constructed with further weight savings, so that it can be handled comfortably and can be pivoted into different settings. Even though the invention can be used especially advantageously with rack and pinion jacks for the above purpose, it can also be used with other winches, e.g. spindle winches.

Other configurations of the invention are included in the present application. Thus, manual cranks could advantageously be carried on both ends of the crankshaft, whereupon a considerably improved manual force transmission to the crank assembly is possible.

Another improvement in the above sense is attained when the crank arms of the two manual crank assemblies are aligned with each other to the side.

A chain, a V-belt or ratchet pulley, or drive shaft or cardan drive can be used as power train between crank and drive shafts. Because they also provide weight reduction, the simple pulley types are preferred.

If, according to still another construction of the invention, the crankcase and each winch housing are provided with connection elements, by means of which the crankcase can be connected to any winch housing, pivotable into different work positions, the operation of the crankcase and its setting in different positions can be further simplified. The operator in this case indeed is relieved of the duty of holding the drive shaft connected in the crankcase by manual force with a relevant rack and pinion jack.

Still another operation simplification is then attained when the connection elements also include locking means in order to fix the crankcase in its different work positions on any winch housing. In this preferred variation, the operator advantageously has both hands free for operation of the crank assembly.

Another configuration of the invention, which is characterized by simplicity and ease of construction, has the clutch elements having a clutch thrust plate fastened on each winch housing with a middle opening for passage of the crankcaseside drive shaft as well as a clutch side bar gearing with the clutch thrust plate on the crankcase, which can be guided behind this element by at least one notch on the periphery of the clutch thrust plate.

It is preferable that the notch(es) is/are arranged for the passage of the clutch side bar at the bottom and/or top peripheral point of the clutch thrust plate.

The locking means could simply have a check bolt arranged movably on the crankcase, which can mesh in corresponding openings on the winch housing or in parts built onto the winch housing.

According to still another configuration of the invention, if the check bolt is arranged movably and spring-mounted, radially movable relative to the clutch thrust plate, and the openings to receive the check bolt are constructed on the periphery of the clutch thrust plate and, furthermore, the radial dimension around which the clutch side bar meshes behind the clutch thrust plate is greater than the depth of the takeup openings for the check bolt, the clutch thrust plate advantageously simultaneously fulfills two functions.

According to still another configuration of the invention, it is advantageous that step-up gearing and/or speed reduction gearing is initiated when the rack and pinion jack is to be driven rapidly upwardly or downwardly along the upright when it is not loaded or even when it carries a small load, while the reduction gearing is initiated for lifting and depositing heavy loads, in order to reduce the manual force required.

An especially simple step-up gearing and/or reduction gearing is attained in that the power train in the crankcase drives at least one more drive shaft, which is mounted in the crankcase offset slightly inward by the first drive shaft on one end of the crankcase, and is driven at a different speed as compared with the first.

With another configuration of the invention, an additional upward and downward gearing and a change of direction of rotation is attained so that the direction of rotation of the first and second drive shafts is identical.

In order to assure the gear change in the crankcase, but also the subsequent gearing of the rack and pinion jack for overloading, one or more overload safety mechanisms could advantageously be built into the manual crank, e.g. in the form of a slipper clutch or a belt loop.

The slipper clutches are preferably provided in the area of the crankshaft or the drive shafts.

If the crankcase is provided with gripping openings, its handling is simplified.

BRIEF DESCRIPTION OF THE DRAWINGS

The invention is explained in more detail hereinafter relative to the drawings of exemplary embodiments. They show.

DESCRIPTION OF THE PREFERRED EMBODIMENTS

Figure 1:
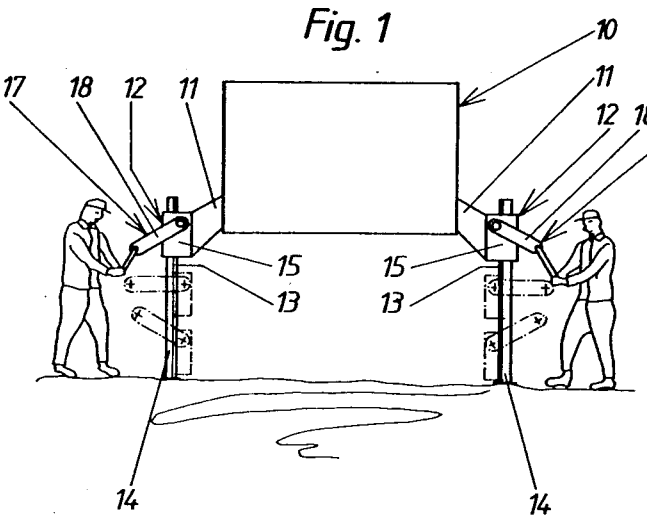
FIG. 1 is a front elevational view of a large container, lifted by means of a lifting and depositing device, of which four rack and pinion jacks are operated by means of two manual crank assemblies with crankcases according to the present invention, in which two work positions of the crankcases shown in broken lines.
Figure 2:
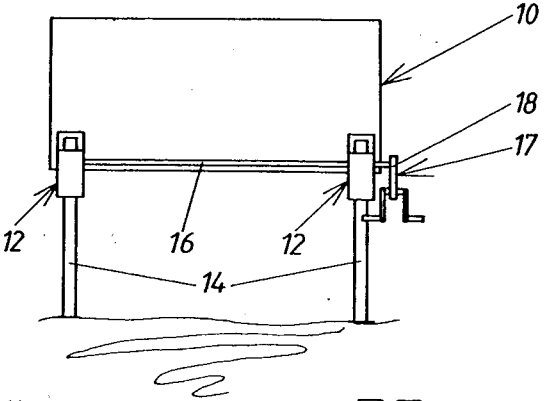
FIG. 2 is a side elevational view of the arrangement shown in FIG. 1.
Figure 3:
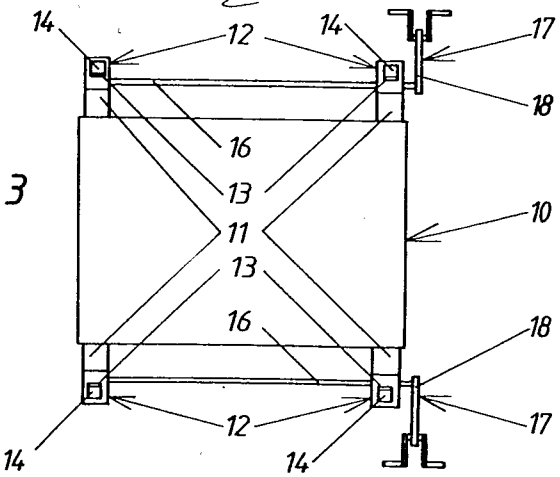
FIG. 3 is a plan view of the arrangement shown in FIGS. 1 and 2.

The lifting and depositing device is described hereinafter as an illustrative example in connection with a large container 10, which is, e.g., a compartment, a container or the like and has a generally rectangular base plan. The lifting and depositing device includes in particular four arms 11 to be connected detachably to the corners of large container 10, and which are connected to rack and pinion jacks or winches 12. Spur racks 13 of these winches 12 are connected to uprights 14, and with operation of the rack and pinion jacks 12 by manual crank assemblies 17 which are still to be described, the winch housing 15 can be raised and lowered along any upright 14.

Each two rack and pinion jacks 12, located along the long sides of large container 10, are connected so that they can be driven by a shaft 16, so only two manual cranks 17 must be operated for the lifting or lowering of large container 10. By means of the lifting and depositing device, therefore, large container 10, for instance, can be lifted from the loading surface of a truck and deposited on the ground or, vice versa, lifted from the ground and deposited on the loading surface. Large container 10, however, can also be supported by the lifting and deposition device at a certain distance over the ground. The four uprights 14 are provided with base plates (not shown) at their bottom ends.

The two manual crank assemblies 17 are identical in construction and therefore it suffices to describe only one in detail herein. Each manual crank 17 has a haft-like crankcase 18 of narrow construction which in the exemplary embodiments of FIGS. 4 and 5 or 8 and 9, comprises two substantially identical halves 19. These crankcase halves 19 are connected with each other by a plurality of screws 20 or the like. On the one end of crankcase 18 is rotatably mounted a crankshaft 21, both ends of which project out of crankcase 18. Crank arms 22 are nonrotatably affixed on the ends of crankshaft 21, by means of pins 23. Crank arms 22 are aligned with one another on their sides and on their free ends support crank handles 24 which are preferably constructed to be foldable.

A first belt pulley 25, over which is guided an endless ratchet belt 26, is mounted on crankshaft 21 within crankcase 18. With its top and bottom portions, ratchet belt 26 extends through hollow spaces 27 and 28 in gear case 18 to the opposite thereof, where it is guided around a second belt pulley 29. Belt pulley 29 is connected to a hollow drive shaft 30, which is rotatably mounted in the other end of crankcase 18. Belt 26, therefore, forms the power train between crankshaft 21 and drive shaft 30, which on its outer end (FIG. 5) supports a square drive journal 31. This square drive journal 31 can be inserted in a corresponding notch in a shaft 32 which forms a part of a winch gearing 33 (FIG. 6), so as to be operatively connected thereto.

Figure 4:
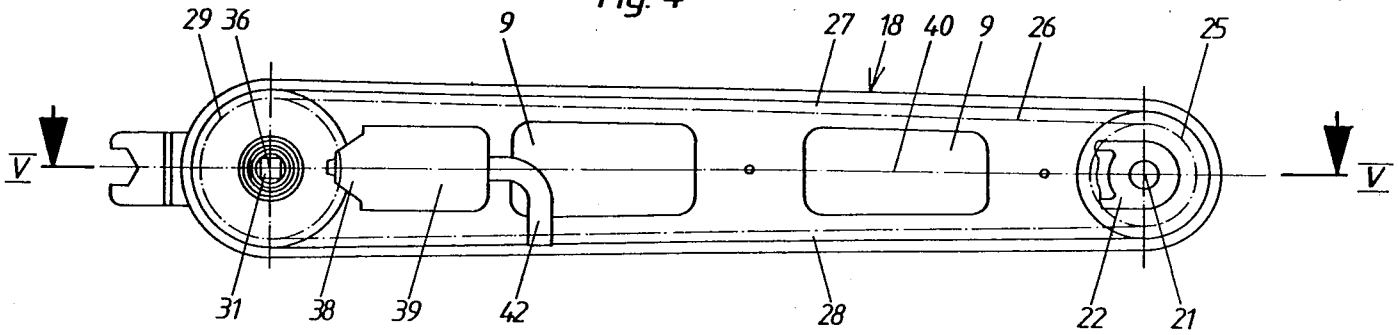
FIG. 4 is a side elevation view of a crankcase according to the present invention.
Figure 5:
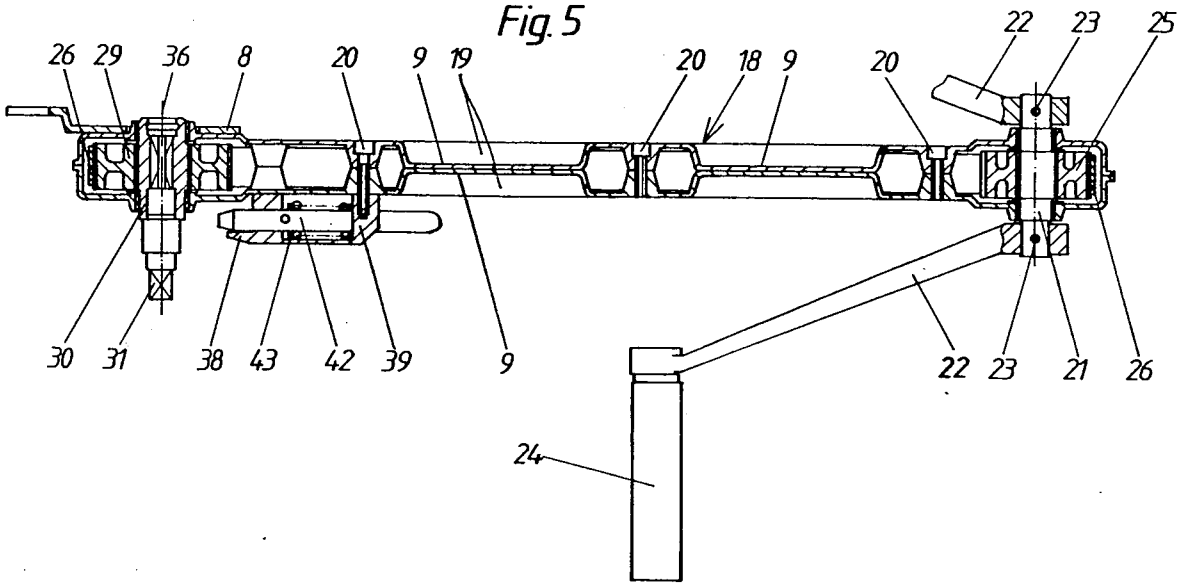
FIG. 5 is a sectional view taken substantially along line V—V of FIG. 4.

For protection of manual crank assembly 17 as well as of winch gearing 33, series-connected for overload, the exemplary embodiment of FIGS. 4 and 5 shows a predetermined loop set between belt 26 and belt pulleys 25 and 29. In this exemplary embodiment, it is also preferred that a downgearing ratio of 1:0.7 be provided between crankshaft 21 and drive shaft 30. However, another down-gearing ratio or a drive ratio of 1:1, which is dependent upon the weights which are to be handled, can also be provided.

The lift lengths which rack and pinion jacks 12 cover along uprights 14 during loading or depositing of large containers 10 are generally 1.70–1.80 m. In the areas of the top and bottom end positions of rack and pinion jacks 12, in order to bring the crank into an ergonomically favorable position for the two operators, the two crankcases 18 can be positioned in the correspondingly differently bent work positions on winch housing 15, as shown in FIG. 1 both in full lines and in broken lines. At this point it is noted that to fulfill the above requirement, crankcases 18 also have a corresponding predetermined length, e.g., of approximately 0.7 m.

Figure 6:
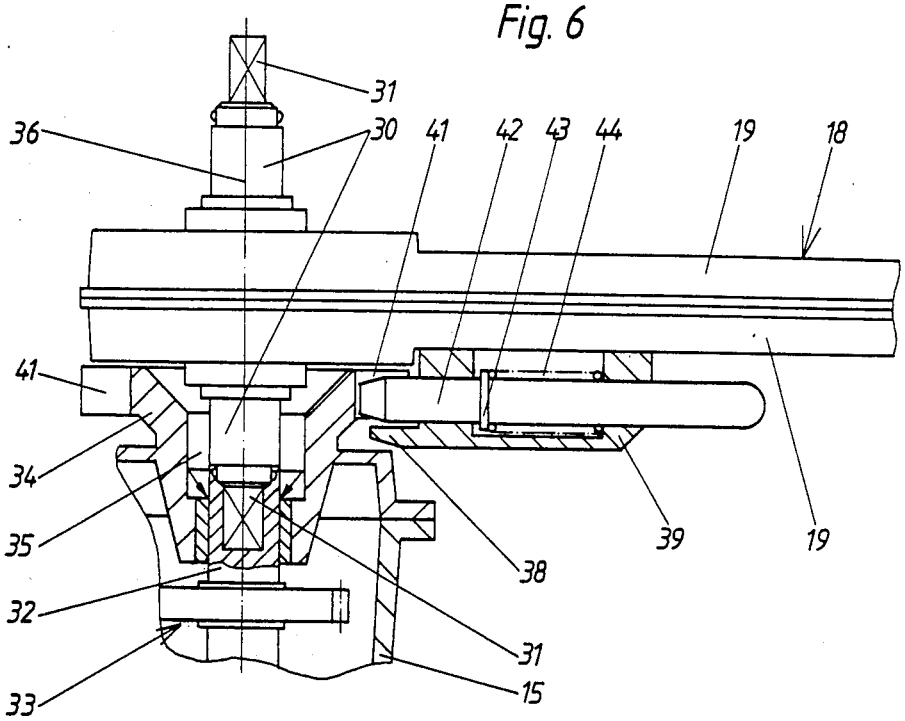
FIG. 6 is a plan view similar to FIG. 5 of one end of the crankcase mounted on a winch housing, in which the drive shaft is connected in the crankcase with a winch gearing, of which only a part is shown.
Figure 7:
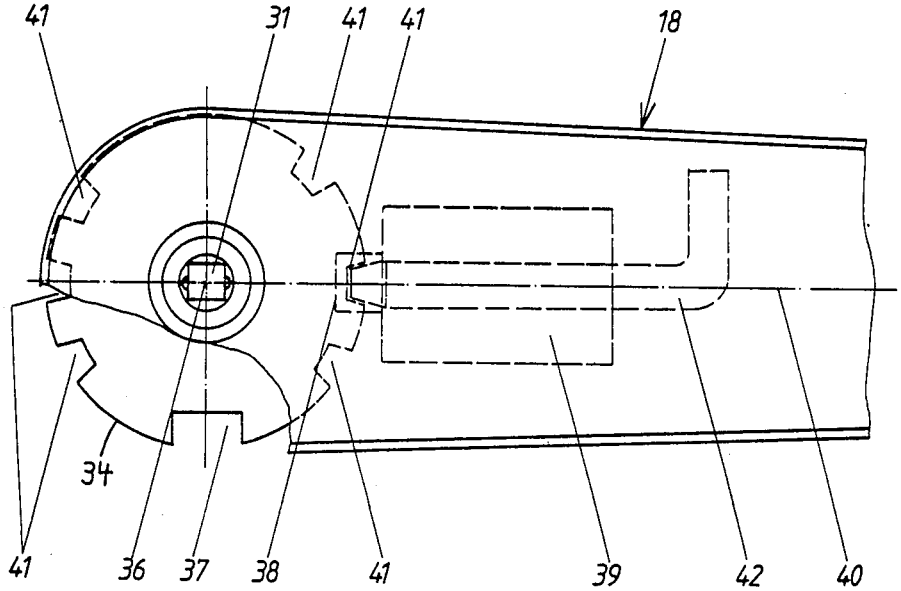
FIG. 7 is a side elevational view of the arrangement shown in FIG. 6, which especially shows the connection and locking elements.

Between each crankcase 18 and winch housing 15 are located clutch elements and locking means to connect each crankcase 18 pivotably on the one hand on each winch housing 15 and, on the other hand, its different work positions on each winch housing 15. The clutch elements include (FIGS. 6 and 7) a clutch thrust plate 34 connected to winch housing 15, which has an opening 35 in the middle, through which drive shaft 30 can be inserted with its square drive journal 31. Clutch thrust plate 34, therefore, is arranged coaxially on the pivot axis 36 of crankcase 18. On its bottom peripheral point, the clutch thrust plate 34 has a notch 37 for the passage of a clutch side bar 38, which is constructed on a bearing part 39 fastened to crankcase 18. Clutch side bar 38 is arranged generally parallel to lengthwise axis 40 of crankcase 18, which intersects pivot axis 36. The arrangement is such that, with insertion of square drive journal 31 into winch housing 15 for the purpose of the drive connection to the relevant winch gearing 33, clutch side bar 38 can be inserted through notch 37, if crankcase 18 is found in a correspondingly vertical, downward-hanging position. If crankcase 18 is then rotated upward around pivot axis 36, clutch side bar 38 engages behind in clutch thrust plate 34, as shown in FIGS. 6 and 7. The drive connection between drive shaft 30 in crankcase 18 and shaft 32 of the relevant winch gearing 33 is assured in this manner.

In order to be able to hold crankcase 18 in the three positions shown in FIG. 1, on winch housing 15, clutch thrust plate 34 is provided on its periphery with two sets of three symmetrically opposite take-up openings 41 for a check bolt 42. Check bolt 42 is mounted radially movable in the bearing part 39 connected to crankcase 18 opposite clutch thrust plate 34. A spring 44 engaging on a ring or ring collar 43 on check bolt 42 tends to press check bolt 42 as shown in FIGS. 6 and 7 (to the left) against the periphery of clutch thrust plate 34. Check bolt 42 is drawn manually to the right against the pressure of spring 44, pressing it into its ineffective position (as in FIGS. 6 and 7), and crankcase 18 can be pivoted around pivot axis 36 into one of its (for example) three work positions (see FIG. 1). As soon as the inner (left) end of check bolt 42, following its release under the pressure of spring 44, enters one of the take-up openings 41, crankcase 18 is fixed on winch housing 15. The operator now has both hands free in order to rotate the crank in one or the other direction. The second set of three take-up openings 41 on the periphery of clutch thrust plate 34 advantageously facilitates its use in winches on both sides of large container 10. FIG. 7 shows that the radial dimension around which clutch side bar 38 engages behind clutch thrust plate 34 is greater than the depth of take-up openings 41. Also, clutch side bar 38 in this exemplary embodiment is also broader than the width of take-up openings 41 for check bolts 42. Thus it is guaranteed that the function of clutch side bar 38 is not impaired by take-up opening 41.

Figure 8:
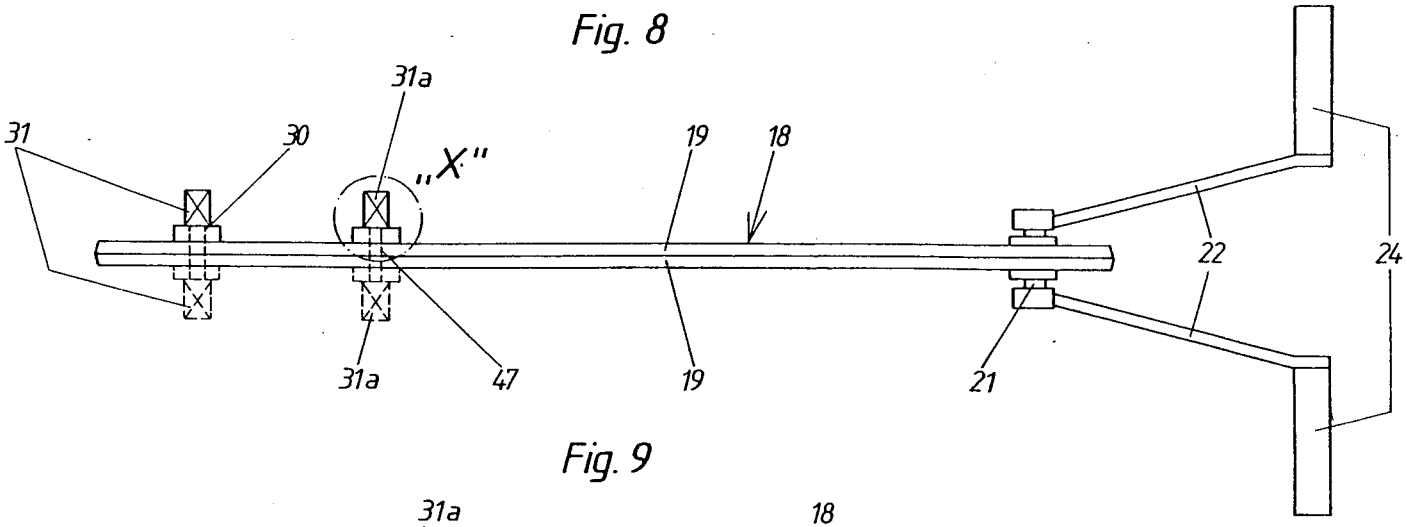
FIG. 8 is a plan view of anotner embodiment of the crankcase with two drive shafts and a pair of manual crank assemblies.
Figure 9:
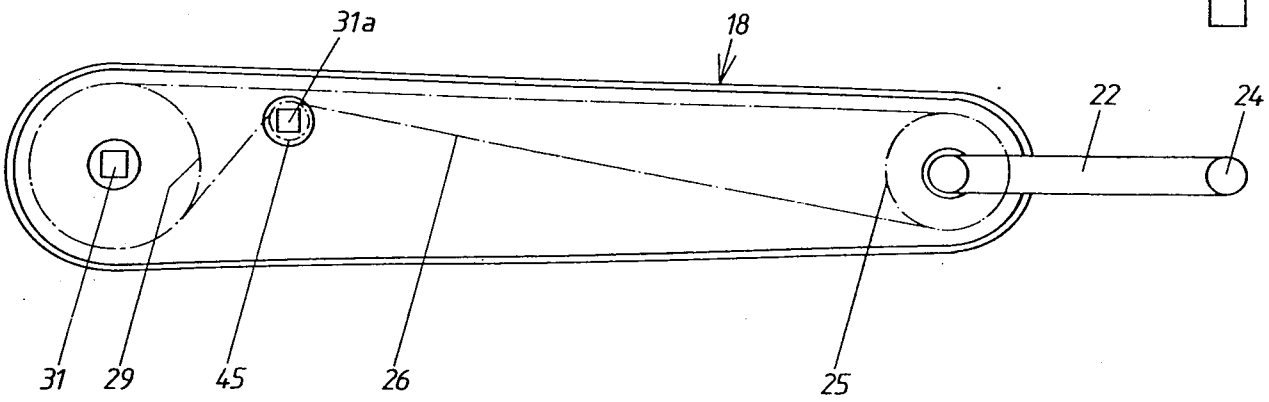
FIG. 9 is a side elevational view of the crankcase of FIG. 8, in which a ratchet pulley is shown clearly in broken lines, which represents the drive connection between the crankshaft and the two drive shafts.
Figure 10:
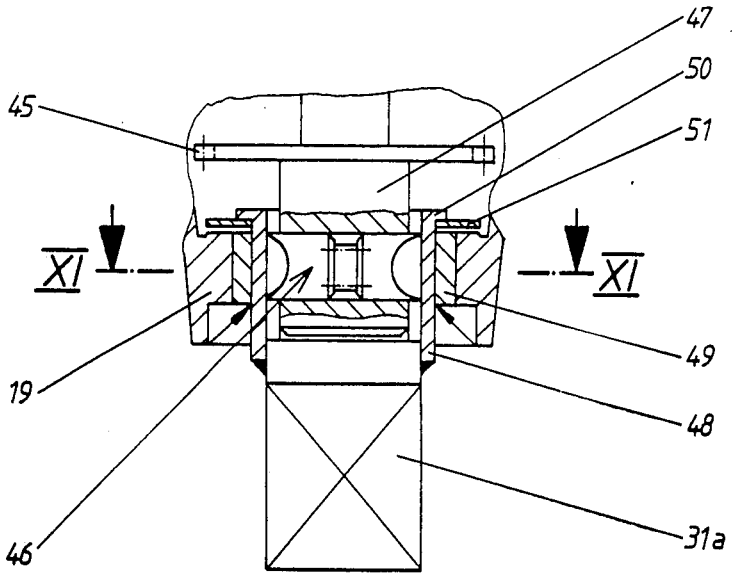
FIG. 10 is an enlarged view of the detail "X" of FIG. 8, shown in section.
Figure 11:
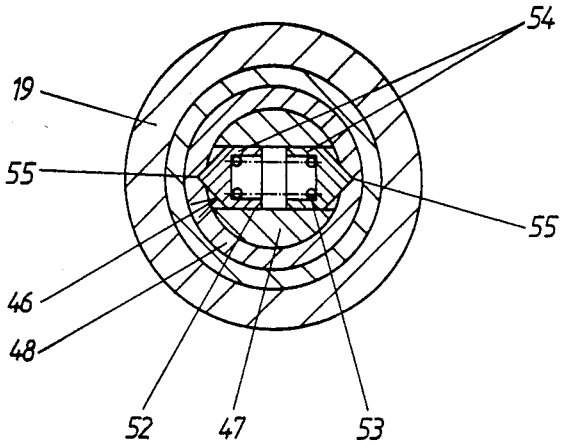
FIG. 11 is a sectional view taken substantially a along line XI—XI of FIG. 10.

FIGS. 6, 8 and 9 show that drive shaft 30 can also be provided with a square drive journal 31 on each end, so that crankcase 18 can be connected, if desired, at one or the other side to a winch housing 15.

FIGS. 8 through 11 show another embodiment of the invention, which has a second drive shaft 47 (FIG. 10), which likewise can support square drive journals 31*a* on both ends. On this second drive shaft 47, which is arranged so that it is offset inwardly from the first drive shaft 30, is mounted a belt pulley 45, in engagement with the ratchet belt 26. This second drive shaft 47 with square drive journal 31*a* is driven at a remarkably higher speed in comparison to the first drive shaft 30 during operation of the manual crank. It is then always used when uprights 14, e.g., are free of any load or are to be moved rapidly under only slight load, downward onto the ground or, vice versa, from the ground upward. It here has to do with the "quick action" of the crank assembly. The translation ratio with a preferred exemplary embodiment is, e.g., 1:3.5. The first drive shaft 30 with square drive journal 31, on the other hand, as in the embodiment of FIGS. 4 and 5, is driven at the ratio 1:0.7 for reduction gearing which then is preferably initiated when correspondingly heavy loads are to be handled.

Furthermore, in the embodiment of FIGS. 8 through 11, a slip clutch 46 (FIGS. 10, 11)is provided as an overload safety mechanism on both drive shafts 30, 47. Since these slip clutches are identical in structure, only one is described, in connection with drive shaft 47. Square drive journal 31*a* is connected to a sheathing 48, which is mounted rotatably in bushing 49, which is built tightly into a corresponding borehole in one half of the crankcase. An annular collar 50 on sheathing 48 in connection with an annular plate 51 prevents sheathing 48 from sliding out of crankcase 18. A transverse bore 52 is located near one end of drive shaft 47 and its drive journal 31*a*. If the resistance to rotation on drive journal 31*a* exceeds a predetermined value, protrusions 55 of clutch members 54 break out of their notches in sheathing 48 and clutch members 54 slide radially inward against the pressure of spring 53, whereupon the drive connection between drive shaft 47 and square drive journal 31*a* is disconnected. Subsequent damage to the winch gearing 33 (FIG. 6) is thus avoided. At the same time, the manual crank assembly is also protected from damage by overloading.

The above described overload safety mechanism in the form of slip clutch 46 is provided on both square drive journals 31 and 31*a*. It can also be provided in the area of crankshaft 21. A structural amplification is then attained in the embodiment with two drive shafts.

Gripping openings 9 on crankcase 18, to simplify its handling, are shown in FIGS. 4 and 5. Furthermore, crankcase 18 can support screw spanners 8, by means of which, e.g., the tightening screws or nuts for arms 11 of rack and pinion winch 12 can be driven in or removed.

What is claimed is:

1. Manual crank assembly for winches, especially for rack and pinion jacks of a lifting and depositing device for a portable box-like article, in which the rack and pinion jacks are connectable to the corners of the article and have spur racks provided on uprights thereof, each rack and pinion jack having gear means in engagement with the rack to enable it to be raised and lowered along its upright, characterized in that:

(a) the manual crank assembly has a haft-like crankcase, which at one end has a crankshaft rotatably mounted thereon and at the other end has a first drive shaft rotatably mounted thereon, said drive shaft having means for releasably connecting it to the gear means of the adjacent rack and pinion jack, and (b) means operatively connecting the crankshaft with the drive shaft so that rotation of the crankshaft will cause rotation of the drive shaft, each jack having a winch housing and characterized in that the crankcase and each winch housing are provided with clutch means (38, 34) to enable the crankcase to be connected to a winch housing in different work positions.

2. Manual crank assembly as in claim 1, characterized in that manual crank arms are connected to both ends of the crankshaft.

3. Manual crank assembly as in claim 2, characterized in that the crank arms are in lateral alignment with each other.

4. Manual crank assembly as in claim 1, characterized in that belt means connects the drive shaft to the crankshaft.

5. Manual crank assembly as in claim 1, characterized in that the clutch means (38, 34) include locking means (41, 42) to releasably lock the crankcase in the different positions on a winch housing.

6. Manual crank assembly as in claim 5, characterized in that the clutch means have a clutch thrust plate (34) connected to each winch housing with an opening (35) in the middle thereof for the passage of the drive shaft (30) on the crankcase side, and a clutch side bar (38) on the crankcase engaging behind the clutch thrust plate (34), the clutch thrust plate (34) having notch (37) on the periphery thereof for the passage of the clutch side bar (38) therethrough.

7. Manual crank assembly as in claim 6, characterized in that the notch (37) for the passage of the clutch side bar (38) is positioned on the bottom peripheral points of the clutch thrust plate (34).

8. Manual crank assembly as in claim 7, characterized in that the locking means comprise a check bolt (42) movably mounted on the crankcase, the winch housing having openings (41) for receiving the check bolt (42) therein.

9. Manual crank assembly as in claim 8, characterized in that the check bolt (42) is radially movable relative to the clutch thrust plate (34), and is spring-mounted, and the openings (41) for the check bolt (42) are constructed on the periphery of the clutch thrust plate (34), and in that the radial dimension around which the clutch side bar (38) engages the clutch thrust plate (34) from behind is greater than the depth of the openings (41) for the check bolt (42).

10. Manual crank assembly as in claim 1, characterized in that the crankshaft, drive shaft and connecting means are so constructed as to effect a predetermined drive ratio between the crankshaft and the drive shaft.

11. Manual crank assembly as in claim 1, characterized in that the manual crank assembly has an overload safety mechanism comprising a slip clutch (46).

12. Manual crank assembly as in claim 11, characterized in that slip clutches (46) are provided in the area of the crankshaft and the drive shaft.

13. Manual crank assembly as in claim 1, characterized in that the crankcase (18) is provided with gripping openings (9).

14. Manual crank assembly for winches, especially for rack and pinion jacks of a lifting and depositing device for a portable box-like artical, in which the rack and pinion jacks are connectable to the corners of the article and have spur racks provided on uprights thereof, each rack and pinion jack having gear means in engagement with the rack to enable it to be raised and lowered along its upright, characterized in that:

(a) the manual crank assembly has a haft-like crankcase, which at one end has a crankshaft rotatably mounted thereon and at the other end has a first drive shaft rotatably mounted thereon, said drive shaft having means for releasably connecting it to the gear means of the adjacent rack and pinion jack, and (b) means operatively connecting the crankshaft with the drive shaft so that rotation of the crankshaft will cause rotation of the drive shaft, a second drive shaft being rotatably mounted on the crankcase (18) and being offset inwardly from the first drive shaft, and means being provided for driving the second drive shaft at a speed different than that of the first drive shaft.

15. A portable manual for crank assembly for winches, especially for rack and pinion jacks of a lifting and depositing device for a portable box-like article, in which the rack and pinion jacks are connectable to the corners of the article and have spur racks provided on uprights thereof, each rack and pinion jack having gear means in engagement with the rack to enable it to be raised and lowered along its upright, characterized in that:

(a) the manual crank assembly has an elongated haft-like crankcase, of a size to be conveniently handled by an operator, said crankcase having at one end a crankshaft rotatably mounted thereon and at the other end thereof a first drive shaft rotatably mounted thereon, said drive shaft having means for releasably connecting it to the gear means of the adjacent rack and pinion jack, and (b) means operatively connecting the crankshaft with the drive shaft so that rotation of the crankshaft will cause rotation of the drive shaft.

* * * * *